US007741763B2

(12) United States Patent
Kumagai et al.

(10) Patent No.: US 7,741,763 B2
(45) Date of Patent: Jun. 22, 2010

(54) SPARK PLUG

(75) Inventors: Kenichi Kumagai, Nagoya (JP); Koji Mizoguchi, Nagoya (JP)

(73) Assignee: NGK Spark Plug Co., Ltd., Nagoya-shi (JP)

( * ) Notice: Subject to any disclaimer, the term of this patent is extended or adjusted under 35 U.S.C. 154(b) by 322 days.

(21) Appl. No.: 11/846,162

(22) Filed: Aug. 28, 2007

(65) Prior Publication Data

US 2008/0054778 A1 Mar. 6, 2008

(30) Foreign Application Priority Data

Aug. 29, 2006 (JP) ..... 2006-231440
Aug. 3, 2007 (JP) ..... 2007-203436

(51) Int. Cl.
*H01T 1/00* (2006.01)

(52) U.S. Cl. ..... 313/143; 123/169 EL

(58) Field of Classification Search ..... None
See application file for complete search history.

(56) References Cited

U.S. PATENT DOCUMENTS 6,414,420 B1 7/2002 Suzuki
2006/0066196 A1 3/2006 Suzuki
2006/0284535 A1 12/2006 Ozeki et al.
2007/0126330 A1 6/2007 Kuki et al.
2009/0102345 A1* 4/2009 Hotta et al. ..... 313/120

FOREIGN PATENT DOCUMENTS

JP 2183989 A 7/1990
JP 6052965 A 2/1994
JP 2000-215964 A 8/2000
JP 2003303661 A 10/2003
JP 2005-183177 A 7/2005
JP 2005190762 A 7/2005
JP 2006-92956 A 4/2006

* cited by examiner

*Primary Examiner*—Ashok Patel
(74) *Attorney, Agent, or Firm*—Sughrue Mion, PLLC

(57) ABSTRACT

A spark plug including a center electrode; an insulator; a metal shell; a ground electrode; and an annular packing, all as defined herein, wherein the packing has a hardness greater than or equal to a hardness of the stepped portion of the metal shell or has a Vickers hardness of not less than 300 Hv. Preferably, a difference between the hardness of the packing and the hardness of the stepped portion of the metal shell is from 120 Hv to 160 Hv, and the packing has a Vickers hardness of not more than 500 Hv.

11 Claims, 2 Drawing Sheets

SPARK PLUG

BACKGROUND OF THE INVENTION

1. Field of the Invention

The present invention relates to a spark plug for use in igniting an internal combustion engine, and more particularly to a spark plug in which a packing is interposed between an insulator and a metal shell.

2. Description of the Related Art

Generally, in a spark plug for use in igniting an internal combustion engine such as an automobile engine, a cylindrical insulator is inserted and held in a cylindrical metal shell. A center electrode for forming a spark discharge gap in opposition to a ground electrode is welded to a leading end side of the metal shell, as well as a terminal electrode for applying a high voltage across the center and ground electrodes, are inserted in an axial hole formed in the insulator. The spark plug is mounted in an internal combustion engine such that a leading end (spark discharge gap) of the spark plug faces the interior of the combustion chamber.

The aforementioned insulator is inserted from a rear end side of the metal shell toward a leading end side thereof. The insulator is fixedly crimped between a rear end of the metal shell and a stepped portion formed on an inner peripheral portion of the metal shell such that a shoulder portion formed on an outer peripheral portion of the insulator is retained by the stepped portion. An annular plate packing is interposed between the stepped portion of the metal shell and the shoulder portion of the insulator so as to maintain airtightness therebetween (e.g., refer to JP-A-2005-190762).

A metallic material whose hardness is lower than that of the metal shell is generally used as the material of the plate packing. When the metal shell is crimped as described above, the plate packing undergoes crush deformation and assumes a state in which it is in close contact with both the metal shell and the insulator. For example, in a case where the hardness of the metal shell is 200 Hv to 300 Hv, a plate packing whose hardness is 180 Hv or thereabouts is used. As a result, the gap between the metal shell and the insulator is set in a closed state, thereby ensuring airtightness of the combustion chamber.

In recent years, in conjunction with trends toward higher power and fuel savings in internal combustion engines, miniaturization and development of smaller diameter spark plugs is underway. In the case where a small-diameter spark plug is fabricated, the wall thickness of the metal shell also becomes thin, so that if the crimping load is large, the strength of the metal shell declines. Hence, there is a possibility that the stepped portion formed on the inner peripheral portion of the metal shell and oriented toward the rear end becomes excessively deformed, to thereby impart a large eccentricity. On the other hand, if the load is made small to prevent the occurrence of this problem, it frequently becomes difficult to ensure airtightness. For this reason, a plate packing having a relatively low hardness is used so that the plate packing is deformed even by a small crimping load, to thereby allow the plate packing to be brought into close contact with the metal shell and the insulator.

Problems to be Solved by the Invention

A predetermined radial clearance is provided between the insulator and the metal shell and between the plate packing and the metal shell for the purpose of improving fabrication yield. Consequently, when the insulator and the plate packing are temporarily assembled to the metal shell at the time of crimping, there is a possibility that the plate packing is placed on the stepped portion of the metal shell in such manner as to be inclined or the insulator is assembled in an off-centered state with respect to the metal shell.

For this reason, in the case where a low-hardness plate packing that is relatively easily deformed is used in a conventional way, if the insulator and the plate packing are in the above-described state at the time of crimping, the plate packing is deformed nonuniformly by the crimping load. As a result, the airtightness may decline, the eccentricity of the insulator may tend to increase due to deformation of the packing, and the alignment between opposing surfaces of the center electrode and the ground electrode may deteriorate.

SUMMARY OF THE INVENTION

The invention has been made in view of the above-described circumstances, and an object thereof is to provide a spark plug which is capable of maintaining airtightness and suppressing alignment deterioration between the center electrode and the ground electrode.

In a first aspect, the above objection of the invention has been achieved by providing a spark plug comprising: an insulator having an axial hole extending in an axial direction and a shoulder portion provided on an outer peripheral surface thereof; a center electrode held at a leading end side of the axial hole; a metal shell having a stepped portion provided on an inner peripheral surface thereof, the stepped portion retaining the shoulder portion of the insulator on a receiving surface thereof; a ground electrode having a rear end portion joined to a leading end portion of the metal shell and a leading end portion facing the center electrode; and an annular packing interposed between the shoulder portion of the insulator and the stepped portion of the metal shell, wherein the packing has a hardness greater than or equal to a hardness of the stepped portion of the metal shell, or has a Vickers hardness of not less than 300 Hv.

In taking into consideration the difference between the amount of deformation of the packing and the amount of deformation of the stepped portion of the metal shell when the same crimping load is applied, the present inventors discovered that (i) when the packing is deformed, there is a large effect on the eccentricity of the insulator with respect to the metal shell, whereas (ii) when the stepped portion of the metal shell is deformed, its effect on eccentricity is small. On the basis of this finding, in the above-described first aspect, the hardness of the packing is made higher than that of the stepped portion of the metal shell or not less than 300 Hv in Vickers hardness to thereby suppress deformation of the packing. This makes it possible to reduce the effect on the eccentricity of the insulator with respect to the metal shell. Consequently, airtightness can be maintained, and deterioration of alignment between the center electrode and the ground electrode can be suppressed. In addition, depending on configuration, unless the packing assumes a proper attitude, the insulator cannot be completely inserted into the metal shell during assembly. Thus, the crimping step cannot be continued, so that the problem of the insulator being fixed in a substantially off-centered state can be reduced.

The abutting surface of the shoulder portion of the insulator and the receiving surface of the stepped portion of the metal shell are generally provided with tapered inclines, so that a decline in airtightness arises if the plate-like packing does not undergo deformation. Accordingly, if the crimping load is to be maintained at a conventional level, the hardness of the packing is preferably set to not more than 500 Hv. Consequently, when the insulator and the packing are temporarily assembled to the metal shell at the time of crimping, even if the packing is placed on the stepped portion of the metal shell in such manner as to be inclined or the insulator is assembled to the metal shell in an off-centered state, the packing can be easily corrected to its proper attitude before deformation. Consequently the eccentricity of the insulator can be easily corrected.

To enhance airtightness, a portion of the packing is preferably sunk so as to subside into the stepped portion of the metal shell. The entire periphery of the packing need not be sunk into the stepped portion of the metal shell, and if a portion thereof is sunk into an indentation formed in the receiving surface of the stepped portion, the airtightness improves. Especially, when the hardness of the packing is made higher than that of the stepped portion of the metal shell, the stepped portion of the metal shell is more likely to deform during crimping than the packing, so that an indentation is formed by the portion of the packing which has sunk into the stepped portion.

Even if the amount of eccentricity of the insulator is the same, the smaller the diameter of the spark plug, the greater the eccentricity ratio. For this reason, in a small-diameter spark plug in which the width of the receiving surface of the stepped portion of the metal shell is not more than 0.7 mm, the effect of misalignment between the center electrode and the ground electrode on ignitability and the like is great. Accordingly, the spark plug of this invention exhibits good alignment between opposing surfaces of the center and ground electrodes even when the width of the receiving surface of the stepped portion of the metal shell is not more than 0.7 mm.

For the same reason, the effect of the invention is greater in a spark plug in which the thread diameter is not more than M12 (12 mm).

The difference between the hardness of the packing and the hardness of the stepped portion of the metal shell is preferably not less than 120 Hv and more preferably not more than 160 Hv.

In a case where the difference in hardness between the packing and the metal shell is excessively large, it is understood that the packing utterly fails to undergo deformation, causing a decline in airtightness. Conversely, in a case where the difference is excessively small, the stepped portion of the metal shell becomes difficult to deform, so as to possibly increase eccentricity of the insulator due to deformation of the packing in a conventional manner. Accordingly, to more reliably obtain the above-described operational effects, the difference in hardness between the packing and the stepped portion of the metal shell is preferably set to not less than 120 Hv and not more than 160 Hv.

DESCRIPTION OF REFERENCE NUMERALS

Figure 1:
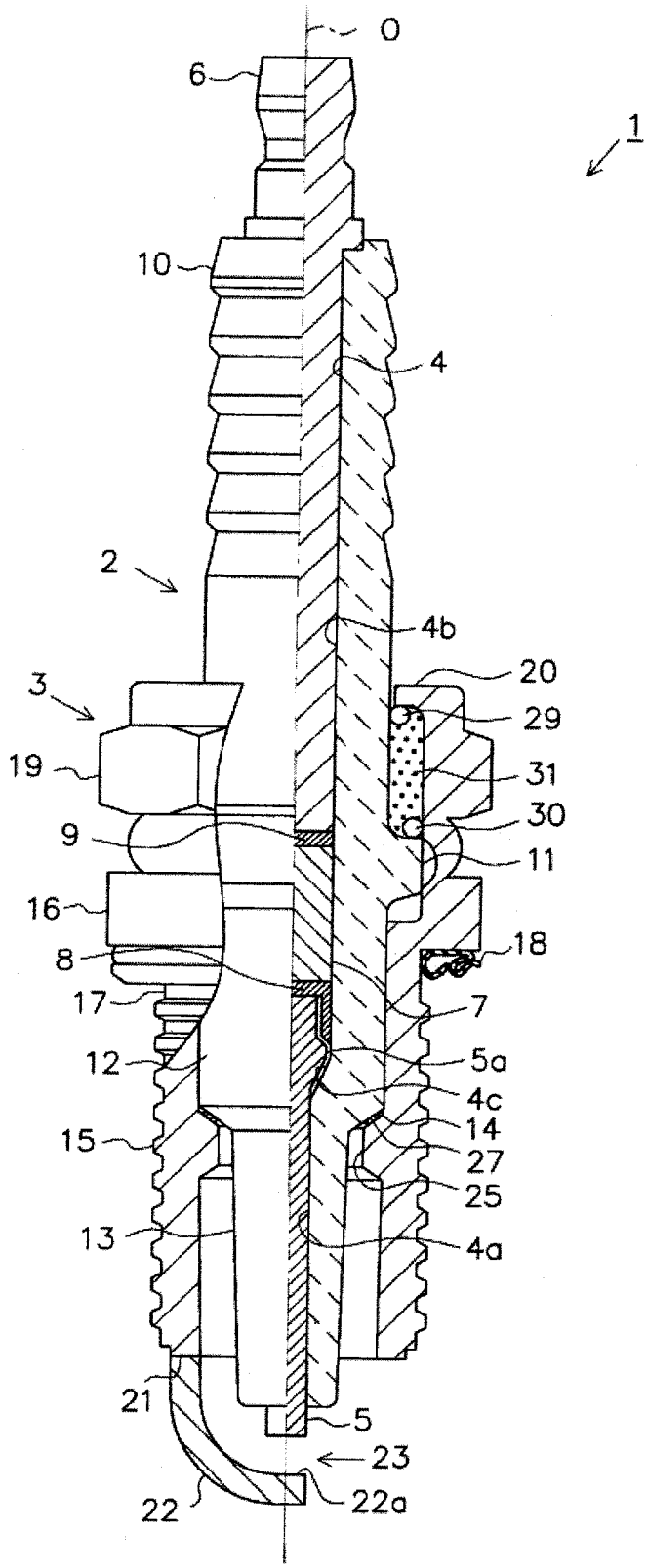
FIG. 1 is a fragmentary front elevational view illustrating the entirety of a spark plug in accordance with an embodiment of the invention.

Reference numerals used to identify various structural features in the drawings include the following.

1: spark plug, 2: insulator, 3: metal shell, 4: axial hole, 5: center electrode, 14: shoulder portion, 14*a*: abutting surface, 20: crimping portion, 22: ground electrode, 25: stepped portion, 25*a*: receiving surface, 27: plate packing

DETAILED DESCRIPTION OF THE INVENTION

Hereafter, a description will be given of an embodiment of the invention with reference to the drawings. However, the present invention should not be construed as being limited thereto. FIG. 1 is a fragmentary front elevational view illustrating a spark plug 1. In FIG. 1, the direction of an axis O the spark plug 1 is a vertical direction in the drawing, the lower side of the drawing is a leading end side of the spark plug 1, and the upper side is a rear end side thereof.

The spark plug 1 is comprised of a cylindrical insulator 2, a cylindrical metal shell 3 holding it, and the like.

An axial hole 4 is penetratingly formed in the insulator 2 along the axis O. A center electrode 5 is inserted and fixed in a leading end portion side of the axial hole 4, and a terminal electrode 6 is inserted and fixed in a rear end portion side thereof. A resistor 7 is disposed between the center electrode 5 and the terminal electrode 6 inside the axial hole 4, and opposite end portions of the resistor 7 are electrically connected to the center electrode 5 and the terminal electrode 6 through glass seal layers 8 and 9, respectively.

More specifically, the axial hole 4 of the insulator 2 includes a small-diameter hole portion 4*a* formed at the leading end side and a large-diameter hole portion 4*b* formed rearwardly of the small-diameter hole portion 4*a* and having a larger diameter than the small-diameter hole portion 4*a*. A receiving surface 4*c* which has a tapered surface or a rounded surface and whose diameter becomes smaller toward its leading end is formed at a connecting portion between the small-diameter hole portion 4*a* and the large-diameter hole portion 4*b*.

The terminal electrode 6 and the resistor 7 are accommodated in the axial hole 4 of the insulator 2 and inserted in the large-diameter hole portion 4*b*, and the center electrode 5 is accommodated therein and inserted in the small-diameter hole portion 4*a*. The center electrode 5 protrudes from the leading end of the insulator 2, and the terminal electrode 6 protrudes from the rear end of the insulator 2. A fixing collar portion 5*a* is formed on a rear end portion of the center electrode 5 so as to protrude radially outward from its outer peripheral surface. In retaining the fixing collar portion 5*a* by the aforementioned receiving surface 4*c*, the center electrode 5 is thereby fixed.

Meanwhile, as generally known in this field of art, the insulator 2 is formed from sintered alumina or the like, and includes in its outer configuration portion a corrugated portion 10 formed at its rear end side; a flange-like large-diameter portion 11 formed so as to protrude radially outward in a substantially central portion in the direction of the axis O; a middle trunk portion 12 formed forwardly of the large-diameter portion 11 and having a smaller diameter than the middle trunk portion 12; and a long leg portion 13 formed forwardly of the middle trunk portion 12 and having a smaller diameter than the long leg portion 13, the long leg portion 13 being exposed to combustion gases when mounted in an internal combustion engine. The leading end side of the insulator 2, including the large-diameter portion 11, the middle trunk portion 12, and the long leg portion 13, is accommodated within the metal shell 3 formed in a cylindrical shape. A shoulder portion 14 is formed at a connecting portion between the long leg portion 13 and the middle trunk portion 12, and the insulator 2 is retained by the metal shell 3 at the shoulder portion 14, as described below.

The metal shell 3 is formed of a metal such as low carbon steel (e.g., S25C) into a cylindrical shape, and has on its outer peripheral surface a threaded portion (externally threaded portion) 15 for mounting the spark plug 1 in an engine head. A seat portion 16 is formed on an outer peripheral surface on the rear end side of the threaded portion 15, and a ring-shaped gasket 18 is provided at a thread neck 17 at the rear end of the threaded portion 15. Further, at the rear end side of the metal shell 3, a tool engagement portion 19 is provided having a hexagonal cross section for engaging a tool, such as a wrench, at the time of installing the metal shell 3 in the engine head, as well as a crimping portion 20 for holding the insulator 2 at the rear end portion.

In addition, a substantially L-shaped ground electrode 22 is welded to a distal end surface 21 of the metal shell 3. The ground electrode 22 is mounted with a predetermined spark discharge gap 23 provided between a discharge surface 22*a* at a leading end thereof and the leading end of the central electrode 5. The inner surface of the ground electrode 22, which is a surface on the side opposing this center electrode 5, is substantially perpendicular to the direction of the axis O of the center electrode 5.

A stepped portion 25 for retaining the insulator 2 is provided on the inner peripheral surface of the metal shell 3 so as to protrude radially inward. The insulator 2 is inserted from the rear end side of the metal shell 3 toward the leading end side. In a state in which the shoulder portion 14 of the insulator 2 is retained by the stepped portion 25 of the metal shell 3, an opening at the rear end side of the metal shell 3 is crimped radially inward, i.e., the aforementioned crimping portion 20 is formed, and the insulator 2 is thereby fixed. An annular plate packing 27 is interposed between respective stepped portions 14 and 25 of the insulator 2 and the metal shell 3. This ensures that the airtightness of the interior of a combustion chamber is maintained, and that the combustion gas entering the gap between the long leg portion 13 of the insulator and the inner periphery of the metal shell 3, which is exposed to the combustion gas, does not leak to the outside.

To render the crimping seal more complete, at the rear end side of the metal shell 3, annular ring members 29 and 30 are interposed between the metal shell 3 and the insulator 2, and a powder of talc 31 is filled around the ring members 29 and 30. Namely, the metal shell 3 holds the insulator 2 by means of the plate packing 27, the ring members 29 and 30, and the talc 31.

Figure 2:
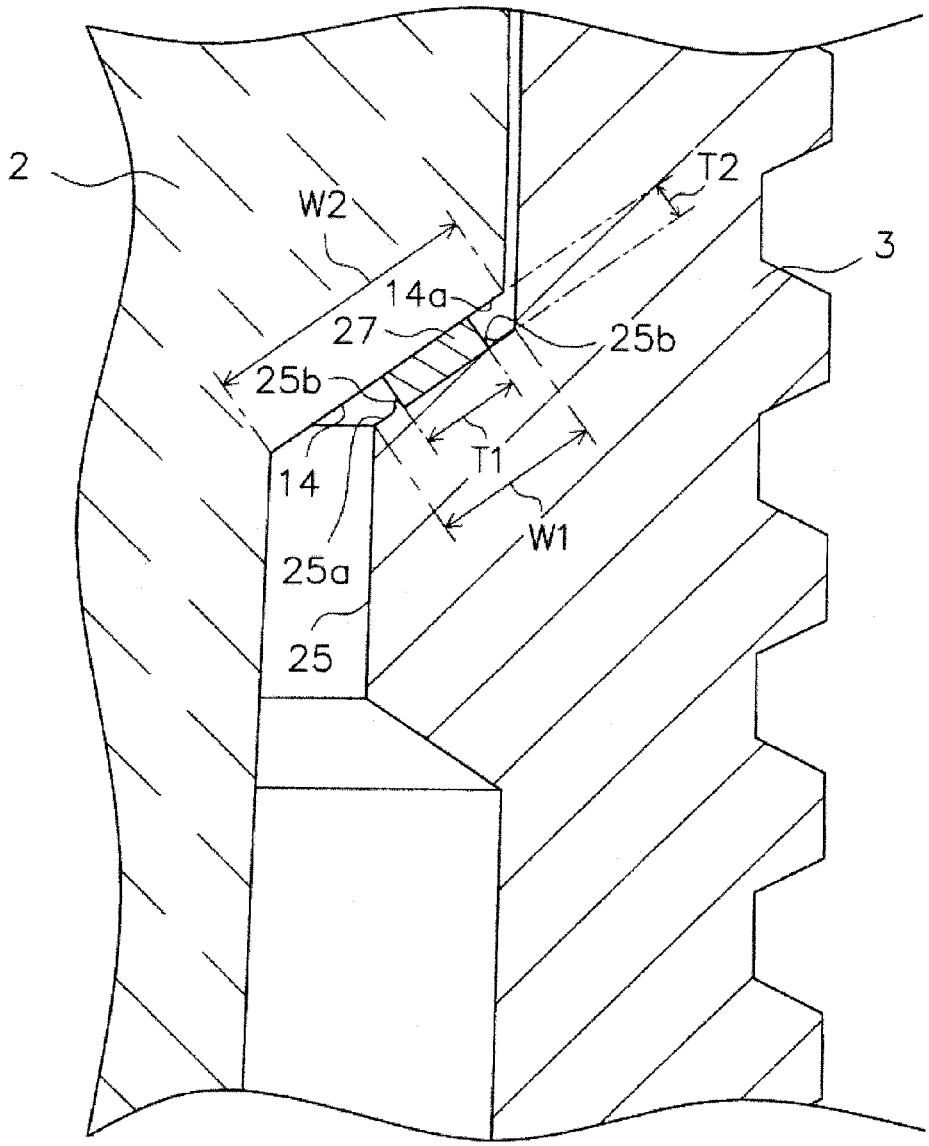
FIG. 2 is an enlarged cross-sectional view schematically illustrating essential portions of a plate packing and its vicinity.

Here, a description will be given of the construction of the plate packing 27 and its vicinity. FIG. 2 is an enlarged cross-sectional view schematically illustrating essential portions of the plate packing 27 and its vicinity.

The plate packing 27 is formed by subjecting an annular piece blanked from a soft steel plate to carburizing treatment or carbonitriding treatment, which is well known to those of ordinary skill in this field of art, and has the shape of a substantially flat plate in a preassembly stage. In the carburizing or carbonitriding treatment, as the treatment time is increased, the hardness of the plate packing thus obtained becomes larger. The treatment temperature and also the specific material selected for the soft steel plate as a starting material will also influence the hardness of the resulting plate packing. That is, a plate packing 27 of the desired Vickers hardness can be made by appropriately setting the time and temperature of the carburizing or carbonitriding treatment, and also by appropriate selection of the starting material (soft steel plate).

Meanwhile, mutually opposing receiving surfaces 14*a* and 25*a* of the stepped portions 14 and 25 of the insulator 2 and the metal shell 3 where the plate packing 27 is interposed are formed into the shape of a tapered surface inclined with respect to the axis O, and are disposed substantially parallel to one another. Further, as the aforementioned crimping is performed, the plate packing 27 in the shape of the substantially flat plate is deformed along both receiving surfaces 14*a* and 25*a*, and assumes a state in which opposing surfaces of plate packing 27 are brought into close contact with the receiving surfaces 14*a* and 25*a*, respectively. At this time, by using a plate packing 27 having a hardness not less than the hardness of the stepped portion 25 of the metal shell 3, as described below, a portion of the plate packing 27 sinks or rather subsides into an indentation formed (by the harder plate packing) in the receiving surface 25*a* of the stepped portion 25 of the metal shell 3 without the cross-sectional shape of the plate packing 27 substantially having undergone crush deformation. As a result, the plate packing 27 is airtightly locked in the indentation formed in the receiving surface 25*a*. The extent of sinking can be determined by observing the stepped portion 25 at the cross section passing through the axis (which substantially coincides with the axis of the spark plug 1) of the metal shell 3, and by observing whether or not projections 25*b* have been formed due to portions of the receiving surface 25*a* of the stepped portion 25 being displaced by the plate packing 27. Since the positions where the projections 25*b* are formed change depending on the degree of deviation between the axes of the insulator 2 and the plate packing 27 when the crimping portion 20 is formed, it suffices if the projection 25*b* is formed on at least one of the inner peripheral side or the outer peripheral side of the plate packing 27. In Sample No. 3, described below, a projection 25*b* having a height of 70 μm was formed in the normal direction of the receiving surface 25*a*. When a projection of not less than 50 μm is formed, a portion of the packing is judged to have sunk into the stepped portion 25 of the metal shell 3. In addition, it has been confirmed that the smaller the diameter of the spark plug, the further the plate packing 27 tends to sink into the stepped portion 25, so that the diameter of the spark plug 1 is preferably small, and more particularly, the thread diameter of the metal shell 3 is preferably not more than M12.

To confirm the operational effects of the plate packing 27, various samples in which the respective conditions were varied, as shown in Table, 1 were fabricated, and various evaluations were made. The results are shown in Table 2. The evaluations shown in Table 2 are relative evaluations among the respective samples, such that even a poor evaluation (x) does not necessarily mean that the test sample in question cannot be used as a product.

TABLE 1

| Sample No. | Thread Size | Width W1 of Receiving Surface of Metal Shell | Width W2 of Abutting Surface of Insulator | Size of Plate Packing Width T1 × Thickness T2 | Hardness of Plate Packing | Hardness of Metal Shell |
|---|---|---|---|---|---|---|
| 1 | M12 | 0.70 mm | 0.80 mm | 0.60 × 0.40 mm | 420 Hv | 260 Hv |
| 2 | M10 | 0.70 mm | 0.80 mm | 0.60 × 0.40 mm | 420 Hv | 280 Hv |
| 3 | M8 | 0.50 mm | 0.65 mm | 0.35 × 0.30 mm | 420 Hv | 300 Hv |
| 4 | M8 | 0.50 mm | 0.65 mm | 0.35 × 0.30 mm | 330 Hv | 330 Hv |
| 5 | M12 | 0.70 mm | 0.80 mm | 0.60 × 0.40 mm | 220 Hv | 260 Hv |
| 6 | M10 | 0.70 mm | 0.80 mm | 0.60 × 0.40 mm | 220 Hv | 280 Hv |
| 7 | M8 | 0.50 mm | 0.65 mm | 0.35 × 0.30 mm | 220 Hv | 300 Hv |
| 8 | M12 | 0.70 mm | 0.80 mm | 0.60 × 0.40 mm | 600 Hv | 260 Hv |
| 9 | M10 | 0.70 mm | 0.80 mm | 0.60 × 0.40 mm | 600 Hv | 280 Hv |
| 10 | M8 | 0.50 mm | 0.65 mm | 0.35 × 0.30 mm | 600 Hv | 300 Hv |
| 11 | M14 | 0.80 mm | 1.10 mm | 0.70 × 0.50 mm | 180 Hv | 250 Hv |
| 12 | M8 | 0.50 mm | 0.65 mm | 0.35 × 0.30 mm | 180 Hv | 300 Hv |

TABLE 2

| | Alignment | | | Airtightness | | |
|---|---|---|---|---|---|---|
| Sample No. | Amount of Eccentricity (mm) | Eccentricity Ratio (%) | Overall Alignment Evaluation | Amount of Leakage (cc/min.) | Airtightness Evaluation | Crimping Play Evaluation |
| 1 | 0.08 | 2.22 | ○ | 5 | ○ | ○ |
| 2 | 0.07 | 2.33 | ○ | 0 | ○ | ○ |
| 3 | 0.05 | 2.17 | ○ | 5 | ○ | ○ |
| 4 | 0.08 | 3.48 | ○ | 10 | Δ | ○ |
| 5 | 0.22 | 6.11 | X | 5 | ○ | ○ |
| 6 | 0.20 | 6.67 | X | 0 | ○ | ○ |
| 7 | 0.20 | 8.70 | X | 5 | ○ | ○ |
| 8 | 0.08 | 2.22 | ○ | 90 | X | ○ |
| 9 | 0.07 | 2.33 | ○ | 60 | X | ○ |
| 10 | 0.05 | 2.17 | ○ | 100 | X | ○ |
| 11 | 0.25 | 5.81 | X | 5 | ○ | ○ |
| 12 | 0.20 | 8.70 | X | 20 | Δ | Δ |

Here, the subject samples were evaluated with respect to (1) alignment between the center electrode 5 and the ground electrode 22, (2) airtightness, and (3) looseness in crimping (crimping play), after the insulator 2 was crimped and held, and in which various constituent conditions were varied as shown in Table 1. In conducting these evaluation tests, 30 test pieces were fabricated of each of Sample Nos 1 to 12. The above-described evaluations (1) to (3) were made on the basis of the measurement results thereof. That is, a total of 30×12=360 test pieces were fabricated and tested. In measuring the amount of eccentricity, the spark plug 1 may be imaged from its leading end side in the direction of the axis O. The center point of a distal inner peripheral surface of the metal shell 3 and the center point of a distal end surface of the center electrode 5 are determined on the basis of that image, and the distance between the two points is measured.

In evaluating the alignment between the center electrode 5 and the ground electrode 22, the average of the maximum value of the amount of eccentricity between the axis of the center electrode 5 and the center of the distal end surface 21 of the metal shell 3 with the ground electrode 22 welded thereto was calculated for each of 30 test pieces constituting an evaluation sample. Here, a sample in which the amount of eccentricity was 0.10 mm or less was judged to be excellent (○), a sample in which the amount of eccentricity was in the range of 0.10 to 0.15 mm was judged to be fair (Δ), and a sample in which the amount of eccentricity was 0.15 mm or more was judged to be poor (x).

Table 2 shows the eccentricity ratio in conjunction with the amount of eccentricity. The eccentricity ratio is calculated from the following Formula (1) on the basis of the amount of eccentricity and the inside diameter of the distal end surface of the metal shell 3.

$$\text{Eccentricity ratio (\%)} = (\text{amount of eccentricity}/(\text{inside diameter}/2) \times 100 \ldots \quad \text{Eq. (1)}$$

A sample in which the eccentricity ratio was 5% or less was judged to be excellent (○), a sample in which the eccentricity ratio was in a range between 5% and 6% was judged to be fair (Δ), and a sample in which the eccentricity ratio was 6% or more was judged to be poor (x). However, in the overall alignment evaluation shown in Table 2, an evaluation combining the determination result of the amount of eccentricity and the determination result of the eccentricity ratio is shown. For example, in a case where one of the two determination results was poor (x), as in Sample No. 11, such case was graded as having a poor (x) overall evaluation.

In evaluating airtightness, an airtightness test pursuant to JIS B 8031, Section 6.5 (1995) (Japanese Industrial Standard) was conducted, and an evaluation of air leakage was made of an average of 30 test pieces constituting each sample. In measuring the airtightness relating to the plate packing 27 alone, a through hole allowing the interior of the metal shell 3 and the outside to communicate with one another was formed in the seat 16 of the metal shell 3, and the amount of air leaking from the plate packing 27 through this through hole was measured by a flow meter. Here, a sample in which the amount of air leakage was 10 cc or less per minute was judged to be excellent (○), a sample in which the amount of air leakage was in the range of 10 cc and 50 cc per minute was judged to be fair (Δ), and a sample in which the amount of air leakage was 50 cc or more per minute was judged to be poor (x).

In the examination of looseness in crimping (crimping play), an impact test pursuant to JIS B 8031, Section 6.4 (1995) was conducted, and a determination was made as to whether or not any play was introduced between the metal shell 3 and the insulator 2. The impact time was set to 60 minutes. Here, a sample which exhibited no abnormality was judged to be excellent (○), a sample in which the blowing off of talc was noted but which exhibited no play (no loosening) was judged to be fair (Δ), and a sample in which play was observed between the metal shell 3 and the insulator 2 was judged to be poor (x).

Next, a specific description will be given of the configurations of Sample Nos. 1 to 12. The width and thickness of the plate packing 27 are dimensions before assembling the spark plug 1, and Vickers hardness was measured after disassembling the test pieces.

The measurement of Vickers hardness was carried out after the test pieces were disassembled and the removed packing plates 27 were cut into small pieces. In this measurement, the load was set to 3N using a diamond indentor.

In the spark plugs of Sample No. 1, the thread diameter was set to M12 (nominal diameter, 12 mm); the width W1 of the receiving surface 25*a* of the stepped portion 25 of the metal shell 3 was set to 0.70 mm; the width W2 of the abutting surface 14*a* of the shoulder portion 14 of the insulator 2 was set to 0.80 mm; the width T1 of the plate packing 27 was set to 0.60 mm; the thickness T2 of the plate packing 27 was set to 0.40 mm; the hardness of the plate packing 27 was set to 420 Hv; and the hardness of the metal shell 3 was set to 260 Hv.

In the spark plugs of Sample No. 2, the thread diameter was set to M10 (nominal diameter, 10 mm); the width W1 of the receiving surface 25*a* of the stepped portion 25 of the metal shell 3 was set to 0.70 mm; the width W2 of the abutting surface 14*a* of the shoulder portion 14 of the insulator 2 was set to 0.80 mm; the width T1 of the plate packing 27 was set to 0.60 mm; the thickness T2 of the plate packing 27 was set to 0.40 mm; the hardness of the plate packing 27 was set to 420 Hv; and the hardness of the metal shell 3 was set to 280 Hv.

In the spark plugs of Sample No. 3, the thread diameter was set to M8 (nominal diameter, 8 mm); the width W1 of the receiving surface 25*a* of the stepped portion 25 of the metal shell 3 was set to 0.50 mm; the width W2 of the abutting surface 14*a* of the shoulder portion 14 of the insulator 2 was set to 0.65 mm; the width T1 of the plate packing 27 was set to 0.35 mm; the thickness T2 of the plate packing 27 was set to 0.30 mm; the hardness of the plate packing 27 was set to 420 Hv; and the hardness of the metal shell 3 was set to 300 Hv.

In the spark plugs of Sample No. 4, the thread diameter was set to M8 (nominal diameter, 8 mm); the width W1 of the receiving surface 25*a* of the stepped portion 25 of the metal shell 3 was set to 0.50 mm; the width W2 of the abutting surface 14*a* of the shoulder portion 14 of the insulator 2 was set to 0.65 mm; the width T1 of the plate packing 27 was set to 0.35 mm; the thickness T2 of the plate packing 27 was set to 0.30 mm; the hardness of the plate packing 27 was set to 330 Hv; and the hardness of the metal shell 3 was set to 330 Hv.

In the spark plugs 1 of Sample No. 5, the thread diameter was set to M12 (nominal diameter, 12 mm); the width W1 of the receiving surface 25*a* of the stepped portion 25 of the metal shell 3 was set to 0.70 mm; the width W2 of the abutting surface 14*a* of the shoulder portion 14 of the insulator 2 was set to 0.80 mm; the width T1 of the plate packing 27 was set to 0.60 mm; the thickness T2 of the plate packing 27 was set to 0.40 mm; the hardness of the plate packing 27 was set to 220 Hv; and the hardness of the metal shell 3 was set to 260 Hv.

In the spark plugs of Sample No. 6, the thread diameter was set to M10 (nominal diameter, 10 mm); the width W1 of the receiving surface 25*a* of the stepped portion 25 of the metal shell 3 was set to 0.70 mm; the width W2 of the abutting surface 14*a* of the shoulder portion 14 of the insulator 2 was set to 0.80 mm; the width T1 of the plate packing 27 was set to 0.60 mm; the thickness T2 of the plate packing 27 was set to 0.40 mm; the hardness of the plate packing 27 was set to 220 Hv; and the hardness of the metal shell 3 was set to 280 Hv.

In the spark plugs of Sample No. 7, the thread diameter was set to M8 (nominal diameter, 8 mm); the width W1 of the receiving surface 25*a* of the stepped portion 25 of the metal shell 3 was set to 0.50 mm; the width W2 of the abutting surface 14*a* of the shoulder portion 14 of the insulator 2 was set to 0.65 mm; the width T1 of the plate packing 27 was set to 0.35 mm; the thickness T2 of the plate packing 27 was set to 0.30 mm; the hardness of the plate packing 27 was set to 220 Hv; and the hardness of the metal shell 3 was set to 300 Hv.

In the spark plugs of Sample No. 8, the thread diameter was set to M12 (nominal diameter, 12 mm); the width W1 of the receiving surface 25*a* of the stepped portion 25 of the metal shell 3 was set to 0.70 mm; the width W2 of the abutting surface 14*a* of the shoulder portion 14 of the insulator 2 was set to 0.80 mm; the width T1 of the plate packing 27 was set to 0.60 mm; the thickness T2 of the plate packing 27 was set to 0.40 mm; the hardness of the plate packing 27 was set to 600 Hv; and the hardness of the metal shell 3 was set to 260 Hv.

In the spark plugs of Sample No. 9, the thread diameter was set to M10 (nominal diameter, 10 mm); the width W1 of the receiving surface 25*a* of the stepped portion 25 of the metal shell 3 was set to 0.70 mm; the width W2 of the abutting surface 14*a* of the shoulder portion 14 of the insulator 2 was set to 0.80 mm; the width T1 of the plate packing 27 was set to 0.60 mm; the thickness T2 of the plate packing 27 was set to 0.40 mm; the hardness of the plate packing 27 was set to 600 Hv; and the hardness of the metal shell 3 was set to 280 Hv.

In the spark plugs of Sample No. 10, the thread diameter was set to M8 (nominal diameter, 8 mm); the width W1 of the receiving surface 25*a* of the stepped portion 25 of the metal shell 3 was set to 0.50 mm; the width W2 of the abutting surface 14*a* of the shoulder portion 14 of the insulator 2 was set to 0.65 mm; the width T1 of the plate packing 27 was set to 0.35 mm; the thickness T2 of the plate packing 27 was set to 0.30 mm; the hardness of the plate packing 27 was set to 600 Hv; and the hardness of the metal shell 3 was set to 300 Hv.

In the spark plugs of Sample No. 11, the thread diameter was set to M14 (nominal diameter, 14 mm); the width W1 of the receiving surface 25*a* of the stepped portion 25 of the metal shell 3 was set to 0.80 mm; the width W2 of the abutting surface 14*a* of the shoulder portion 14 of the insulator 2 was set to 1.10 mm; the width T1 of the plate packing 27 was set to 0.70 mm; the thickness T2 of the plate packing 27 was set to 0.50 mm; the hardness of the plate packing 27 was set to 180 Hv; and the hardness of the metal shell 3 was set to 250 Hv.

In the spark plugs of Sample No. 12, the thread diameter was set to M8 (nominal diameter, 8 mm); the width W1 of the receiving surface 25*a* of the stepped portion 25 of the metal shell 3 was set to 0.50 mm; the width W2 of the abutting surface 14*a* of the shoulder portion 14 of the insulator 2 was set to 0.65 mm; the width T1 of the plate packing 27 was set to 0.35 mm; the thickness T2 of the plate packing 27 was set to 0.30 mm; the hardness of the plate packing 27 was set to 180 Hv; and the hardness of the metal shell 3 was set to 300 Hv.

As seen from the evaluation results shown in Table 2, in Sample Nos 1 to 3 in which the hardness of the plate packing 27 was set higher than that of the metal shell 3, evaluations of "excellent (○)" were obtained in each of the tests relating to alignment, airtightness and crimping play, respectively. More particularly, in Sample No. 1, the amount of eccentricity was 0.08 mm; the eccentricity ratio was 2.22%; and the amount of air leakage was 5 cc per minute. In Sample No. 2, the amount of eccentricity was 0.07 mm; the eccentricity ratio was 2.33%; and the amount of air leakage was 0 cc per minute. In Sample No. 3, the amount of eccentricity was 0.05 mm; the eccentricity ratio was 2.17%; and the amount of air leakage was 5 cc per minute. In addition, with regard to Sample No. 4 in which the hardness of the plate packing 27 was set to be the same as that of the metal shell 3, the evaluations of alignment and crimping play were "excellent (○)," but the evaluation of airtightness was "fair (Δ)". More specifically, in Sample No. 4, the amount of eccentricity was 0.08 mm; the eccentricity ratio was 3.48%; and the amount of air leakage was 10 cc per minute.

Meanwhile, as seen from the evaluation results of Sample Nos 4 to 6 in which the same configurations as those of Sample Nos 1 to 3 were adopted excluding the hardness of the plate packing 27, in cases where the hardness of the plate packing 27 was set lower than that of the metal shell 3, the evaluation of alignment was "poor (x)". This was attributable to the fact that when subjected to a pressing force due to crimping, the plate packing 27 undergoes crush deformation uniformly, and the opposing positions of the center electrode 5 and the ground electrode 22 deviate from one another. More specifically, in Sample No. 5, the amount of eccentricity was 0.22 mm; the eccentricity ratio was 6.11%; and the amount of air leakage was 5 cc per minute. In Sample No. 6, the amount of eccentricity was 0.20 mm; the eccentricity ratio was 6.67%; and the amount of air leakage was 0 cc per minute. In Sample No. 7, the amount of eccentricity was 0.20 mm; the eccentricity ratio was 8.70%; and the amount of air leakage was 5 cc per minute.

In addition, as seen from the evaluation results of Sample Nos 8 to 10 in which the same configurations as those of Samples Nos 1 to 3 were adopted excluding the hardness of the plate packing 27, in cases where the hardness of the plate packing 27 was set to 600 Hv, the evaluation of airtightness became "poor (x)". This was attributable to the fact that since the plate packing 27 was too hard, the plate packing 27, when subjected to a pressing force due to crimping, underwent a small amount of deformation. As a result, the degree of adhesion between the shoulder portion 14 of the insulator 2 and the stepped portion 25 of the metal shell 3 was reduced. More specifically, in Sample No. 8, the amount of eccentricity was 0.08 mm; the eccentricity ratio was 2.22%; and the amount of air leakage, 90 cc per minute. In Sample No. 9, the amount of eccentricity was 0.07 mm; the eccentricity ratio was 2.33%; and the amount of air leakage was 60 cc per minute. In Sample No. 10, the amount of eccentricity was 0.05 mm; the eccentricity ratio was 2.17%; and the amount of air leakage was 100 cc per minute.

In addition, in Sample Nos. 11 and 12, since the hardness of the plate packing 27 was lower than that of the metal shell 3 as in Sample Nos 4 to 6, the evaluation of alignment was "poor (x)". In particular, in Sample No. 12 in which the thread diameter was small at M8, only a grade of "fair (Δ)" was obtained relating to evaluations of airtightness and crimping play. More particularly, in Sample No. 11, the amount of eccentricity was 0.25 mm; the eccentricity ratio was 5.81%; and the amount of air leakage was 5 cc per minute. In Sample No. 12, the amount of eccentricity was 0.20 mm; the eccentricity ratio was 8.70%; and the amount of air leakage was 20 cc per minute.

From the above evaluation results, it can be understood that, in the spark plug 1 whose thread diameter is M12 or less, if the hardness of the plate packing 27 is set to not less than the hardness of the metal shell 3, the alignment between the center electrode 5 and the ground electrode 22 improves as compared to the case where the hardness of the plate packing 27 is set to be lower than that of the metal shell 3. The reason is that in the case where the hardness of the plate packing 27 is set to be lower than that of the metal shell 3, in the spark plug 1 whose thread diameter is M12 or less, there is a high possibility of the eccentricity ratio of the insulator 2 becoming large. In other words, conceivably, if the hardness of the plate packing 27 is greater than or equal to that of the metal shell 3, when the insulator 2 and the plate packing 27 are assembled to the metal shell 3 during crimping, even if the insulator 2 is assembled to the metal shell 3 in an off-centered state or the plate packing 27 is placed on the stepped portion 25 of the metal shell 3 in such manner as to be inclined, the plate packing 27 can be easily corrected to its proper attitude before deformation. Consequently the eccentricity of the insulator 2 can be easily corrected, thereby improving the above-described alignment.

In this embodiment, by taking into consideration the fact that the hardness of a metal shell 3 is generally 200 Hv to 300 Hv, the spark plug 1 is adopted employing a plate packing 27 having a Vickers hardness of 300 Hv or more and whose thread diameter is M12 or less. However, in a case where the hardness of the metal shell 3 exceeds 300 Hv as in Sample No. 4, a plate packing 27 having a hardness of not less than the hardness of the metal shell 3 is adopted. By adopting a plate packing 27 having a hardness of 500 Hv or less, in particular, adhesiveness between the insulator 2 and the metal shell 3 can be enhanced, and a reduction in airtightness can be suppressed.

The invention is not limited to the particulars of the above-described embodiment, and may be implemented as described below, for example.

(a) The material, shape, dimensions, and the like of the spark plug 1 are not limited to those of the above-described embodiment. For example, the invention may be applied to a spark plug 1 whose thread diameter is greater than M12.

(b) In the above-described embodiment, as the plate packing 27, one which is blanked out from a soft steel plate and subjected to carbonitriding treatment is adopted. However, the invention is not limited to the same, and it is possible to adopt a plate packing which is formed from other metallic materials.

(c) In the above-described embodiment, a plate packing 17 having a hardness of not less than 300 Hv and not more than 500 Hv is adopted (however, in the case where the hardness of the metal shell 3 exceeds 300 Hv, a plate packing having a hardness that is greater than or equal to the hardness of the metal shell 3 is adopted). Apart from such a plate packing 27, in the case where the hardness of the metal shell 3 is 250 Hv, for example, a plate packing 27 having a hardness (e.g., 280 Hv) which is greater than that of the metal shell 3 may be adopted.

(d) In the above-described embodiment, although the state of the plate packing 27 is such that a portion of subsides into the receiving surface 25*a* of the stepped portion 25 of the metal shell 3 by crimping, the plate packing 27 need not necessarily assume a sunken state.

(e) The plate packing 27 or the receiving surface 25*a* of the stepped portion 25 of the metal shell 3 may be provided with plating or the like, as required.

It should further be apparent to those skilled in the art that various changes in form and detail of the invention as shown and described above may be made. It is intended that such changes be included within the spirit and scope of the claims appended hereto.

This application is based on Japanese Patent Application JP 2006-231440, filed Aug. 29, 2006, and Japanese Patent Application JP 2007-203436, filed Aug. 3, 2007, the entire contents of which are hereby incorporated by reference, the same as if set forth at length.

What is claimed is:

1. A spark plug comprising:

an insulator having an axial hole extending in an axial direction and a shoulder portion provided on an outer peripheral surface thereof;

a center electrode held at a leading end side of the axial hole;

a metal shell having a stepped portion provided on an inner peripheral surface thereof, the stepped portion retaining the shoulder portion of the insulator on a receiving surface thereof;

a ground electrode having a rear end portion joined to a leading end portion of the metal shell and a leading end portion facing the center electrode; and an annular packing interposed between the shoulder portion of the insulator and the stepped portion of the metal shell, wherein the packing has a Vickers hardness greater than or equal to a Vickers hardness of the stepped portion of the metal shell.

2. The spark plug as claimed in claim 1, wherein the annular packing has a Vickers hardness of not more than 500 HV.

3. The spark plug as claimed in claim 1, wherein a portion of the packing is sunk into the stepped portion of the metal shell.

4. The spark plug as claimed in claim 1, wherein a width of a receiving surface of the stepped portion of the metal shell is not more than 0.7 mm.

5. The spark plug as claimed in claim 1, wherein a thread diameter of the metal shell is not more than 12 mm.

6. The spark plug as claimed in claim 1, wherein a difference between the hardness of the packing and the hardness of the stepped portion of the metal shell is from 120 Hv to 160 Hv.

7. The spark plug as claimed in claim 1, wherein the packing has a width of from 0.3 mm to 0.6 mm.

8. A spark plug comprising:

an insulator having an axial hole extending in an axial direction and a shoulder portion provided on an outer peripheral surface thereof;

a center electrode held at a leading end side of the axial hole;

a metal shell having a stepped portion provided on an inner peripheral surface thereof, the stepped portion retaining the shoulder portion of the insulator;

a ground electrode having a rear end portion joined to a leading end portion of the metal shell and a leading end portion facing the center electrode; and an annular packing interposed between the shoulder portion of the insulator and the stepped portion of the metal shell, wherein the stepped portion has an indentation into which a portion of the packing is sunk.

9. The spark plug as claimed in claim 1, wherein the packing has a Vickers hardness of not less than 300 Hv.

10. The spark plug as claimed in claim 1, wherein the packing has a Vickers hardness greater than a Vickers hardness of the stepped portion of the metal shell.

11. The spark plug as claimed in claim 8, wherein the packing has a Vickers hardness not less than the Vickers hardness of the stepped portion, the indentation is formed in a receiving surface of the stepped portion which receives the packing, and the indentation is defined by a projection of not less than 50 μm formed due to a portion of the receiving surface being displaced by the packing.

* * * * *